US006189401B1

(12) United States Patent
Atwell et al.

(10) Patent No.: US 6,189,401 B1
(45) Date of Patent: Feb. 20, 2001

(54) ELECTRICAL JOYSTICK CONTROLLER

(75) Inventors: Anthony Keith Atwell, Newport; Jeffrey French, Blackwood, both of (GB)

(73) Assignee: Penny & Giles Controls LTD, West Sussex (GB)

( * ) Notice: Under 35 U.S.C. 154(b), the term of this patent shall be extended for 0 days.

(21) Appl. No.: 09/194,085

(22) PCT Filed: May 14, 1997

(86) PCT No.: PCT/GB97/01312

§ 371 Date: Nov. 9, 1998

§ 102(e) Date: Nov. 9, 1998

(87) PCT Pub. No.: WO97/44723

PCT Pub. Date: Nov. 27, 1997

(30) Foreign Application Priority Data

May 18, 1996 (GB) ..... 9610462
Oct. 28, 1996 (GB) ..... 9622341

(51) Int. Cl.[7] ..... G05G 9/047
(52) U.S. Cl. ..... 74/471 XY; 200/6 A; 345/161
(58) Field of Search ..... 74/471 XY; 200/6 A; 345/161

(56) References Cited

U.S. PATENT DOCUMENTS 3,401,574 * 9/1968 Doolittle ..... 74/471 XY
3,818,154 * 6/1974 Presentey ..... 74/471 XY
5,176,041 1/1993 Meier et al. .
5,493,931 2/1996 Niskanen .
5,852,953 * 12/1998 Ersoy ..... 74/471 XY

FOREIGN PATENT DOCUMENTS 1 268 251 5/1968 (DE) .
4305282 A1 8/1994 (DE) .
2107029A 4/1983 (GB) .
2155156A 9/1985 (GB) .

* cited by examiner

*Primary Examiner*—David A. Bucci
*Assistant Examiner*—William C Joyce
(74) *Attorney, Agent, or Firm*—David P. Gordon; David S. Jacobson; Thomas A Gallagher

(57) ABSTRACT

A joystick controller includes a pivoted lever, a main bush carried on the lever and co-operating with a cam surface, and a secondary bush carried on the lever and biased against an inclined surface of the main bush to bias the main bush against the cam surface. The secondary bush abuts a stop when the lever is pivoted through a predetermined angle parallel to a major axis of displacement such that farther displacement in the same direction causes the secondary bush to slide along the inclined surface of the main bush and displace along the lever against the bias. Accordingly, increased resistance to displacement is provided.

8 Claims, 8 Drawing Sheets

ELECTRICAL JOYSTICK CONTROLLER

BACKGROUND OF THE INVENTION

1. Field of the Invention

The present invention relates to an electrical joystick controller.

2. State of the Art

It is sometimes required that, when the joystick control lever reaches a predetermined position after displacement along one of its major axes, that it can be displaced further in the same direction but only upon application of a significantly increased force (i.e. the operator experiences significantly increased resistance when moving the control lever beyond the predetermined position). In one known joystick controller, this is achieved in that a bush, carried on the joystick lever and spring-biased against a fixed cam surface, reaches a more steeply-inclined portion of the cam surface. A problem with this is that the position of the joystick lever, along the respective major axis, at which the bush engages the steeper portion of the cam, tends to vary according to the position of the joystick lever along its other, orthogonal major axis. Thus, the electrical signal from the joystick transducer arrangement for the one major axis, at which the increased resistance takes effect, varies depending on the position of the joystick lever along the other major axis. This is a problem for example where a threshold level of that signal is to be used to indicate that the operator has effected the additional displacement of the joystick lever, in order to initiate a particular control function of the apparatus or machine being controlled by the joystick device.

We have now devised a joystick controller which overcomes the above problem.

SUMMARY OF THE INVENTION

Thus, in accordance with the present invention, there is provided an electrical joystick controller, comprising a pivoted joystick lever, a main bush carried on the joystick lever and co-operating with a cam surface, a secondary bush carried on said lever and biased against an inclined surface of the main bush to correspondingly bias the main bush against the cam surface, and a stop against which a portion of the secondary bush abuts when said lever is pivoted through a predetermined angle parallel to a major axis of displacement, such that further displacement of said lever in the same direction causes said secondary bush to slide along said inclined surface of the main bush and displace against said bias.

The arrangement is therefore such that the operator experiences significantly increased resistance to movement of the joystick lever if he displaces the lever further in the same direction after the secondary bush has met the stop.

The stop may be made as a surface extending generally perpendicular to the respective major axis of movement of the joystick lever, and arranged such that the increased resistance to movement commences at substantially the same position of the lever parallel to that axis, regardless of the position to which it may have been moved along the other, orthogonal major axis of movement. Some compensation may be desirable, in order to fully achieve this result. Thus, once the joystick lever has been moved to its end position along the one major axis, then as it is moved along the other orthogonal axis, its main and therefore secondary bushes will be displaced further along the lever against the return bias: if the stop surface was perfectly straight, the result would be to force the lever slightly in the return direction along the one major axis. Preferably therefore, and in order to compensate for this, the stop surface comprises two portions which are inclined outwardly starting from the center of that surface.

The stop may be formed generally square in shape, such that the same increased-resistance effect is experienced for movements of the joystick lever in either direction along each of its two major axes of displacement.

In some circumstances, it is desirable to be able to move the joystick lever to a position of increased-resistance, or "overpress" position, along either major axis, and thereafter to be able to move the lever to an overpress position along the other major axis. In order to achieve this, preferably the above-described "overpress" arrangement is effective for one major axis of displacement, and the joystick controller includes a separate arrangement to provide the "overpress" feature on the second major axis of displacement. In particular, preferably the cam surface, with which the main bush co-operates, is provided on a cradle which pivots when the joystick lever is moved along the second major axis: a leading edge of the cradle slides on a stationary surface of the controller such that the cradle is displaced along the joystick lever (against the return bias); at a predetermined position, the latter surface includes an inclined portion or more steeply inclined portion, to provide increased resistance to movement along the respective major axis.

It is an advantage of the above-defined arrangements that the increased-resistance effect does not use the underside of the main bush, as in the known joystick mentioned above. Thus, excessive wear of the main cam surface of the main bush, particularly at a localised region corresponding to the respective direction of displacement, is avoided, such that the normal cam action, for returning the lever to its center or neutral position, is not compromised.

It is sometimes desirable to be able to temporarily lock the joystick lever at a predetermined angle of displacement, at least in one specific direction of displacement. We have now devised a simple but effective arrangement for achieving this.

Thus, in accordance with the present invention, there is provided an electrical joystick controller, comprising a pivoted joystick lever and a main bush carried on the joystick lever and biased against a co-operating a cam surface, said cam surface being formed with a recess into which a portion of said main bush locates at a predetermined position of displacement of said joystick lever.

A joystick controller in accordance with the invention may be provided with the increased-resistance or "overpress" feature, or with the temporary locking feature, or with both features combined. In the latter case, the temporary lock is preferably engaged at the end of the "overpress" travel in that particular direction.

In some circumstances, it is desirable to be able to lock the joystick lever temporarily as just described, at the end of a displacement along one major axis, and thereafter be able to move the joystick lever along the other, orthogonal major axis. For this purpose, preferably the cam surface, with which the main bush co-operates, is provided on a cradle of the form described above: the joystick lever can be displaced along the one major axis, until its main bush locks into the detenting recess formed in the cam surface of the cradle. However, the cradle pivots when the joystick lever is moved along the second major axis, as described above.

Embodiments of the present invention will now be described by way of examples only and with reference to the accompanying drawings.

DETAILED DESCRIPTION OF THE PREFERRED EMBODIMENTS

Figure 1:
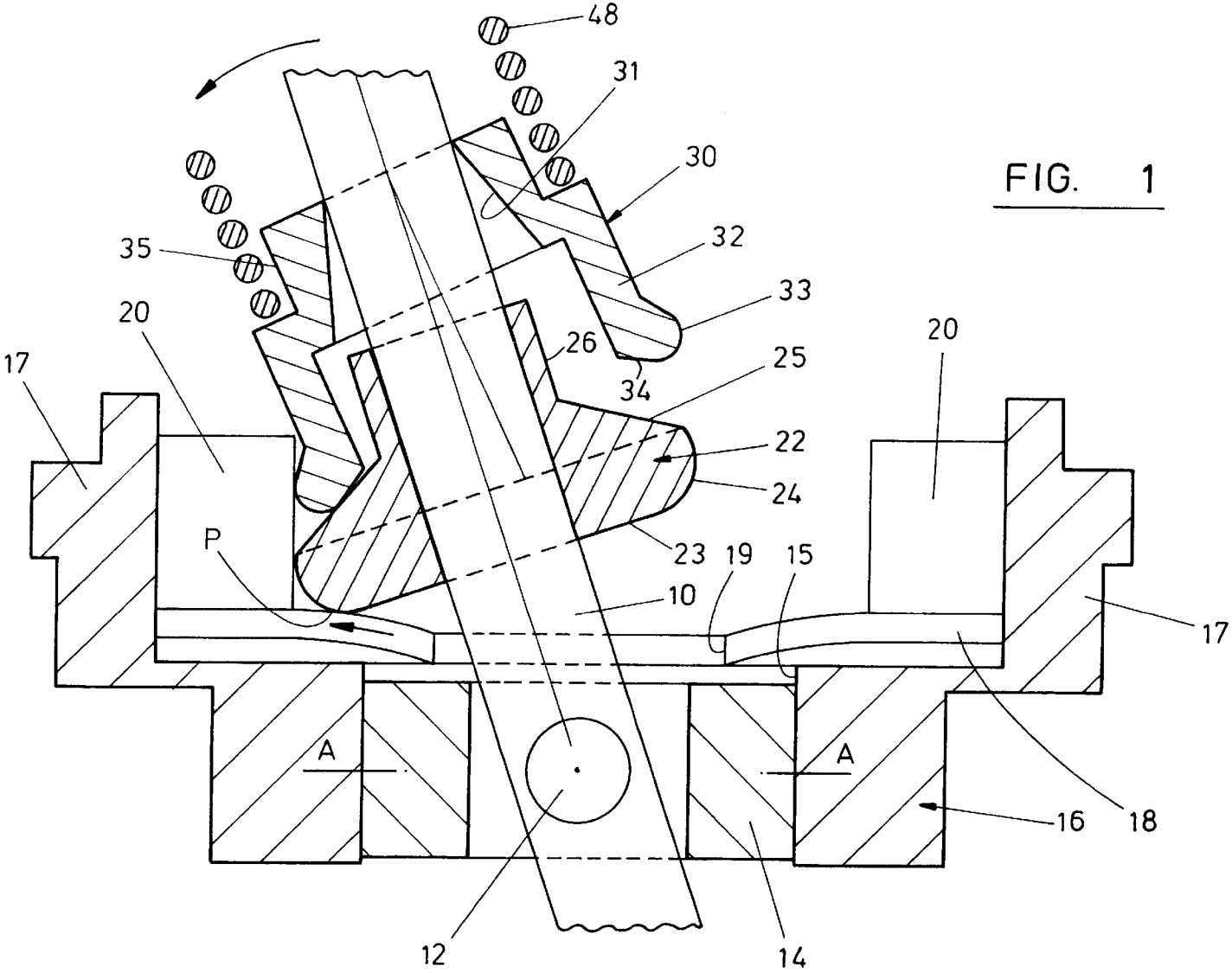
FIG. 1 is a vertical section through a portion of a first embodiment of joystick controller in accordance with the invention.

Referring to FIG. 1 of the drawings, there is shown an electrical joystick controller which comprises a shaft 10 pivoted on a pin 12 which passes through the shaft 10 and into opposite sides of a frame-shaped gimbal 14. The gimbal 14 is disposed within an aperture 15 in the base of a body 16 of the joystick, and is pivoted on studs (not shown) for pivoting relative to the body 16 on an axis A—A perpendicular to the axis of pin 12. A wall 17 projects upwardly from the top of the body 16 and extends around its periphery (which is square in plan view). A cam plate 18 sits on the top of the base of body 16 and its square periphery is located against the inner sides of the peripheral wall 17 of the body 16. The cam plate 18 has a central, circular aperture 19 through which the joystick shaft 10 projects: as shown, the upper surface of the cam plate 18 slopes upwardly, immediately adjacent the aperture 19, then slopes progressively less steeply until, around its periphery, the top surface has a margin which is flat and parallel to the plane of the aperture 19. A stop member 20 is provided, in the form of a square-shaped frame, which sits on the flat peripheral margin of the cam plate 18 and against the inner sides of the upstanding wall 17 of the body 16. The inner sides of the stop member 20 form a square, in plan view, and lie in planes substantially perpendicular to the plane of the aperture 19 in the cam plate 18.

A main bush 22 is provided, having a through-bore receiving the joystick shaft 10 as a sliding fit. The bush 22 is circular in plan view, has an underside 23 which is substantially flat, and a rim 24 which is convex-curved in section as shown. The upperside of the bush 22 is formed with a conical surface 25, the wider end of which joins the curved rim 24 and the narrower end of which joins a reduced-diameter top portion 26.

A secondary bush 30 is also provided, having an axial opening 31 through which the joystick shaft 10 extends. The secondary bush 30 has a tubular projection 32 on its lower end, terminating in a peripheral rim 33 which projects radially outwardly. The tubular projection 32 has a conical end surface 34 complementary to the conical surface 25 of the main bush 22. The rim 33 is convex-curved in section as shown.

It will be appreciated that the secondary bush 30 is normally positioned coaxially on the joystick shaft 10, with its conical end surface 34 sitting, all around it circumference, on the conical surface 25 of the main bush 22. A helical spring 48 is disposed around the upper portion of the joystick shaft 10, has its upper end engaged against a stop member fixed to the shaft, and its lower end engaged around a reduced-diameter top portion 35 of the secondary bush. The spring is under compression, to urge the secondary bush 30 against the main bush 22 and into the coaxial disposition mentioned above. However, it will be noted that the opening 31 in the secondary bush 30 is conical, widening outwardly towards the lower end of the bush, to enable the secondary bush to tilt relative to the joystick shaft 10, as shown in FIG. 1.

The helical spring urges the secondary bush 30 downwardly and onto the main bush 22 as described above, and thus in turn urges the main bush 22 downwardly along the shaft 10. The effect is to urge the shaft 10 to a central, upright position in which the rim 24 of the main bush sits, all around its circumference, on the top surface of the cam plate 18 concentrically with and adjacent the perimeter of the aperture 19 in the cam plate 18.

It will be appreciated that the joystick shaft 10 has two major axes of displacement, which are orthogonal to each other, parallel to the respective pairs of opposite sides of the square defined by the inner surfaces of the stop member 20. The joystick controller further includes an electrical transducer arrangement (not shown) with which the lower end of the shaft 10 co-operates, to provide two electrical signals, one signal representing the displacement of the shaft 10 along or parallel to one of its major axes of displacement, and the other signal representing the displacement of the shaft 10 along or parallel to the other of its major axes of displacement.

As the joystick shaft 10 is pivoted in any direction away from its central, upright position, this tilts the main bush 22 so that only a corresponding point P of the circumference of its rim 24 remains in contact with the top surface of the cam plate 18: this point of the main bush 22 moves outwardly along the top surface of the cam plate 18, progressively moving the main bush 22 (and with it the secondary bush 30) upwardly along the joystick shaft, so progressively compressing the helical bias spring. Thus, the spring bias effects a resistance to the pivoting movement of the joystick shaft 10.

Once the joystick shaft 10 has been moved through a predetermined angle along either of its orthogonal axes (parallel to the respective opposite sides of the square stop member 20), the rim 33 of the secondary bush 30 abuts the inner surface of the corresponding side of the stop member 20. The joystick shaft 10 can be moved further in the same direction, but a significantly greater force of resistance is met: this is because as movement of the shaft 10 proceeds, the main bush 22 continues to move with the shaft 10, but the rim 33 of the secondary bush 30 is prevented from moving in the same direction, and so slides up the conical surface 25 of the main bush 22, the secondary bush 30 being tilted relative to the shaft 10 and main bush 22 (as shown in FIG. 1) and so further compressing the bias spring. Eventually, the rim 24 of the main bush 22 itself abuts the inner surface of the corresponding side of the stop member 20 (as shown in FIG. 1) to prevent further pivoting movement of the joystick shaft 10 in that direction.

Figure 2:
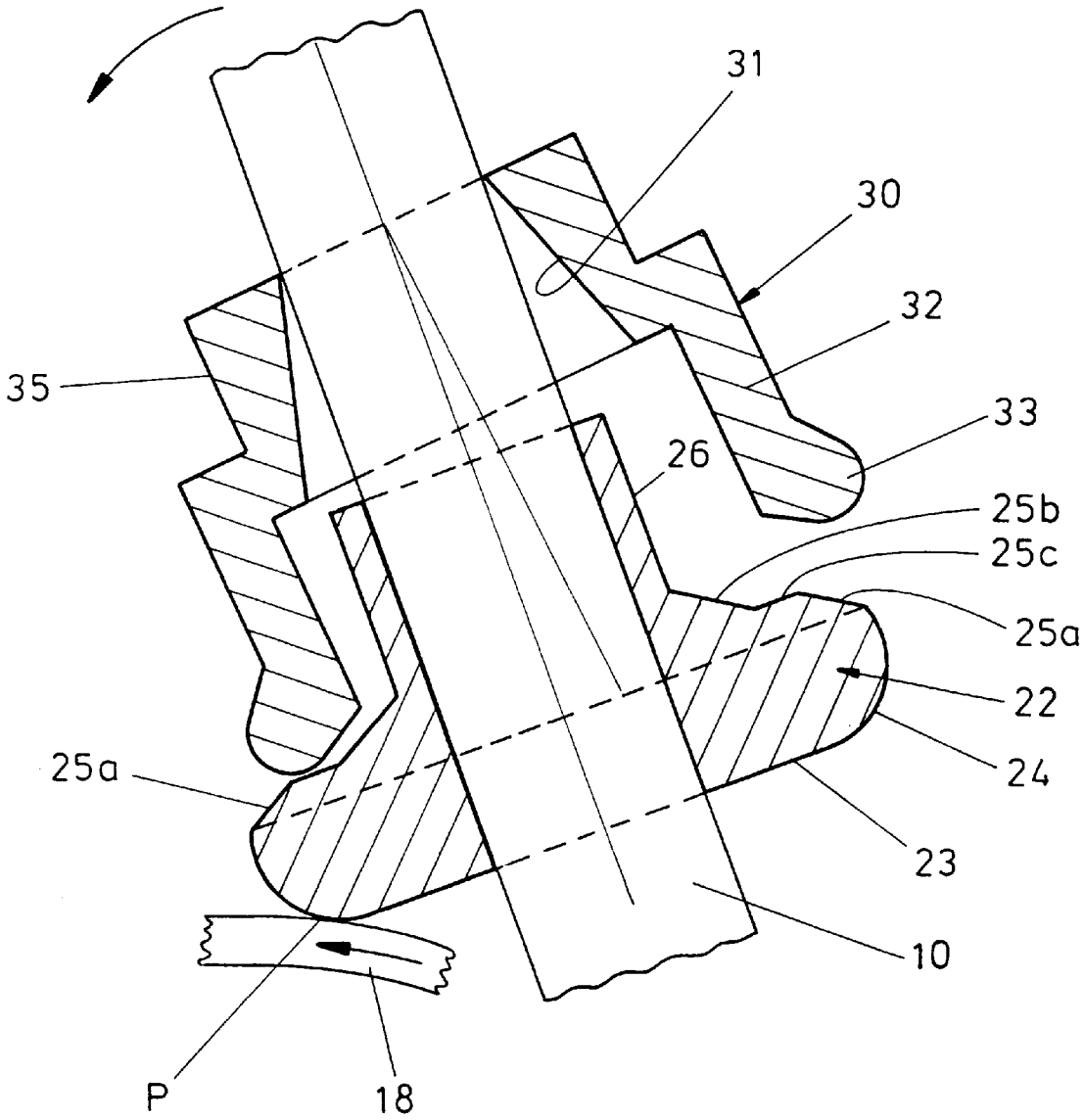
FIG. 2 is a similar sectional view of a modified main bush for the joystick controller of FIG. 1.

As shown in FIG. 2, the upper surface of the main bush may be formed with first and second conical surfaces 25*a*, 25*b* separated by a shoulder 25*c*. Thus, when the rim 33 of the secondary bush 30 abuts the stop member 20, the joystick shaft 10 can firstly be moved through a further angle in the same direction but at increased resistance, as the rim 33 of the secondary bush 30 slides up the first conical surface 25*a* of the main bush 22. Then the rim 33 of the secondary bush 30 slides on the shoulder 25*c* as the movement of the shaft 10 proceeds, further tilting the secondary bush but without displacing it further against the spring bias and therefore without significant increase in the resistance to movement of the shaft 10. Finally, the rim 33 of the secondary bush 30 meets and slides up the second conical surface 25*b*, causing the secondary bush 30 to be tilted further with, consequently, another significant increase in resistance.

Figure 3:
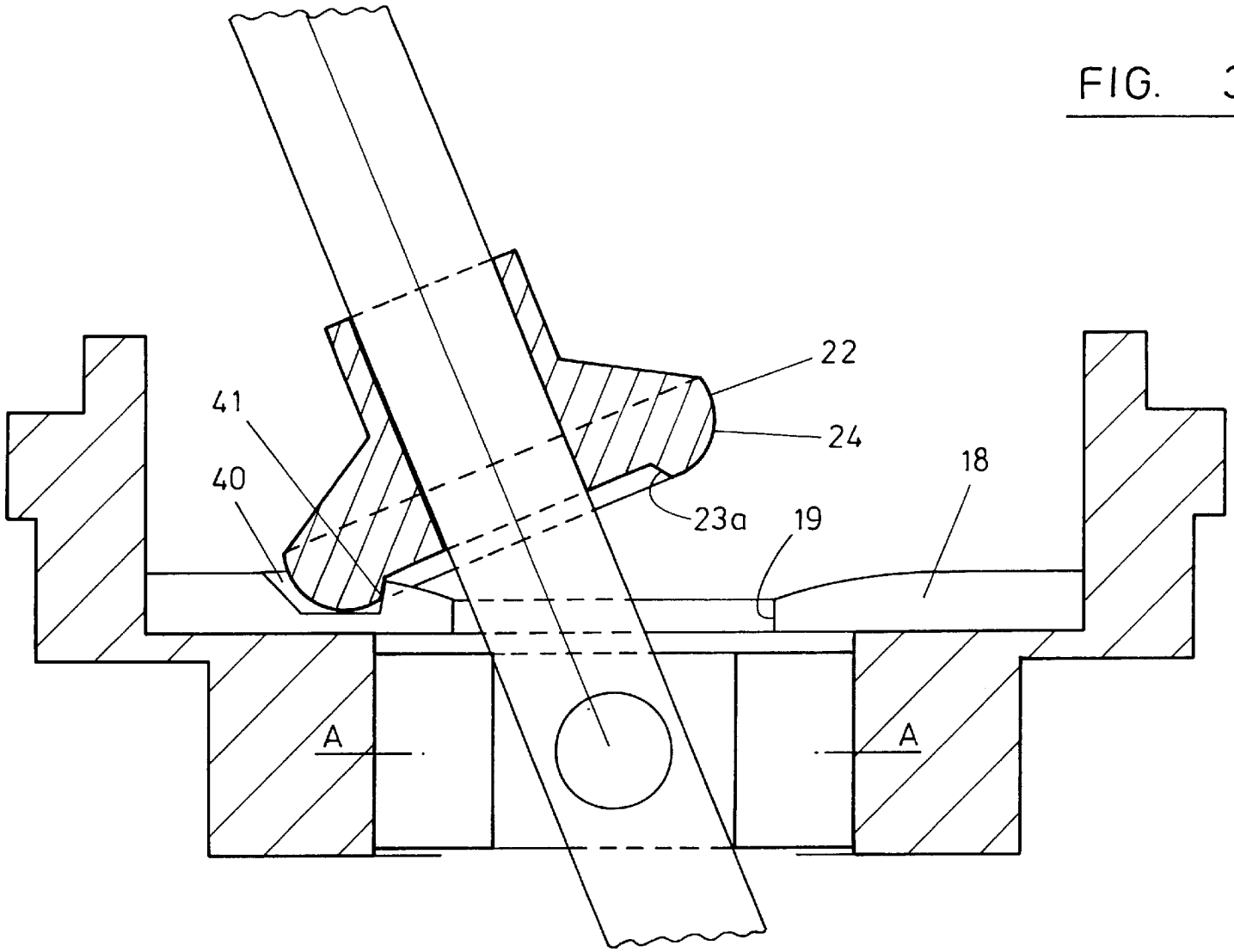
FIG. 3 is a section similar to FIG. 1, of a second embodiment of joystick controller.

FIG. 3 shows a second embodiment of joystick controller, which differs from the joystick controller shown in FIG. 1 in that an,arrangement is provided for temporarily locking the joystick lever at a predetermined angle of displacement along one of its major axes. Thus, a recess 40 is formed in the top surface of the cam plate 18, the recess being spaced radially outwardly from the central aperture 19 in the cam plate 18 along one of the major axes of displacement of the shaft 10, and extending for a short circumferential distance. On its radially-inner edge, the recess has an abrupt shoulder 41 to form a detent. The underside of the main bush 22 is formed with a circular recess having an abrupt peripheral shoulder 23*a*. As shown, once the joystick shaft 10 has been moved through a predetermined angle in one direction along the respective major axis of displacement, the corresponding portion of the rim 24 of the main bush 22 locates into the recess 40 and the shoulder 23*a* on the main bush 22 abuts the shoulder 41 of the recess 40 to hold the joystick shaft 10 in that position. The shaft 10 can be released by pulling it back towards its central position, causing the corresponding portion of the rim 24 of the main bush 22 to ride up and out of the recess 40. In FIG. 3, the stop member and the secondary bush have been omitted for clarity.

Figure 4:
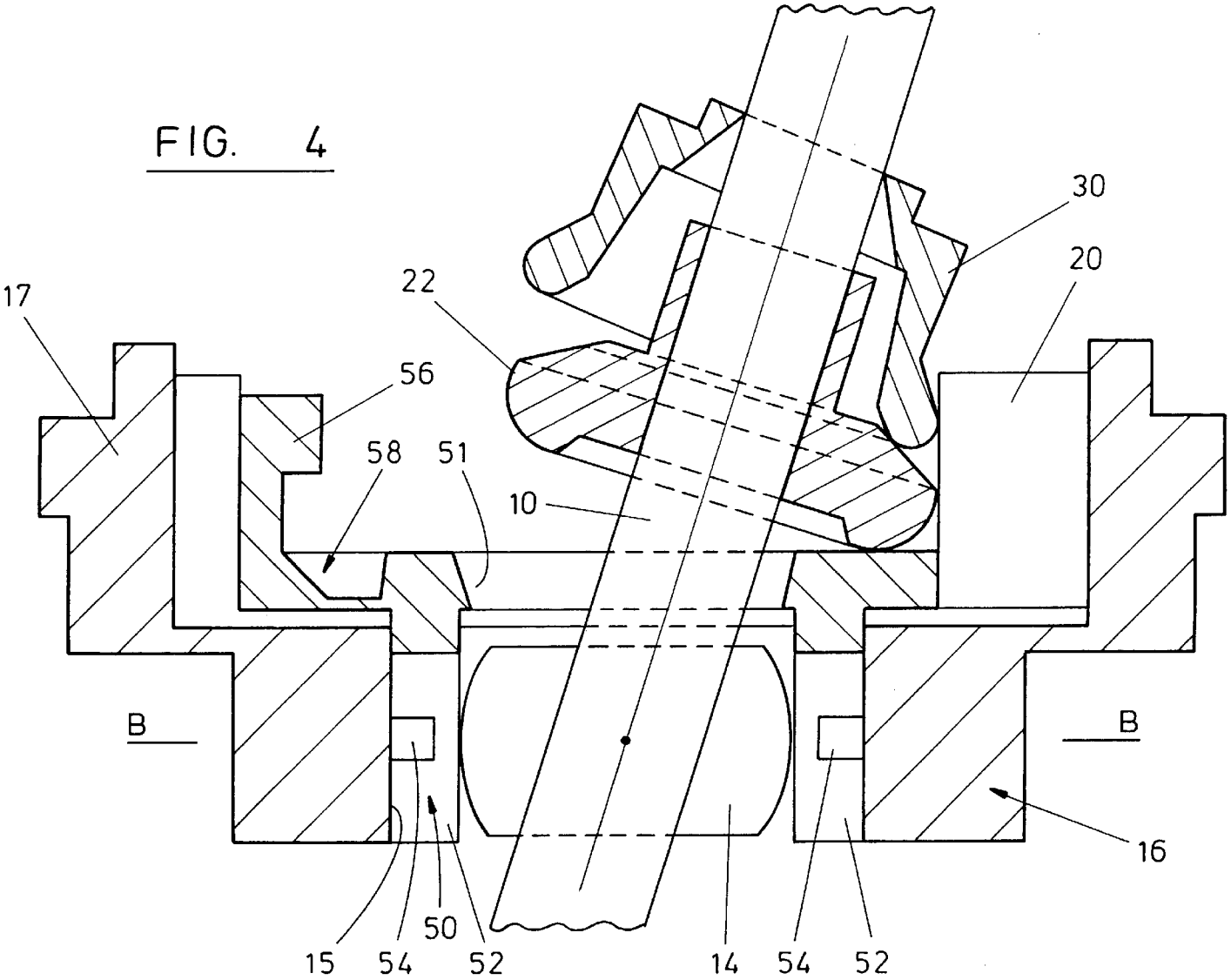
FIG. 4 is a section similar to FIG. 1, of a third embodiment of joystick controller showing the joystick lever displaced in one direction along a major axis.
Figure 5:
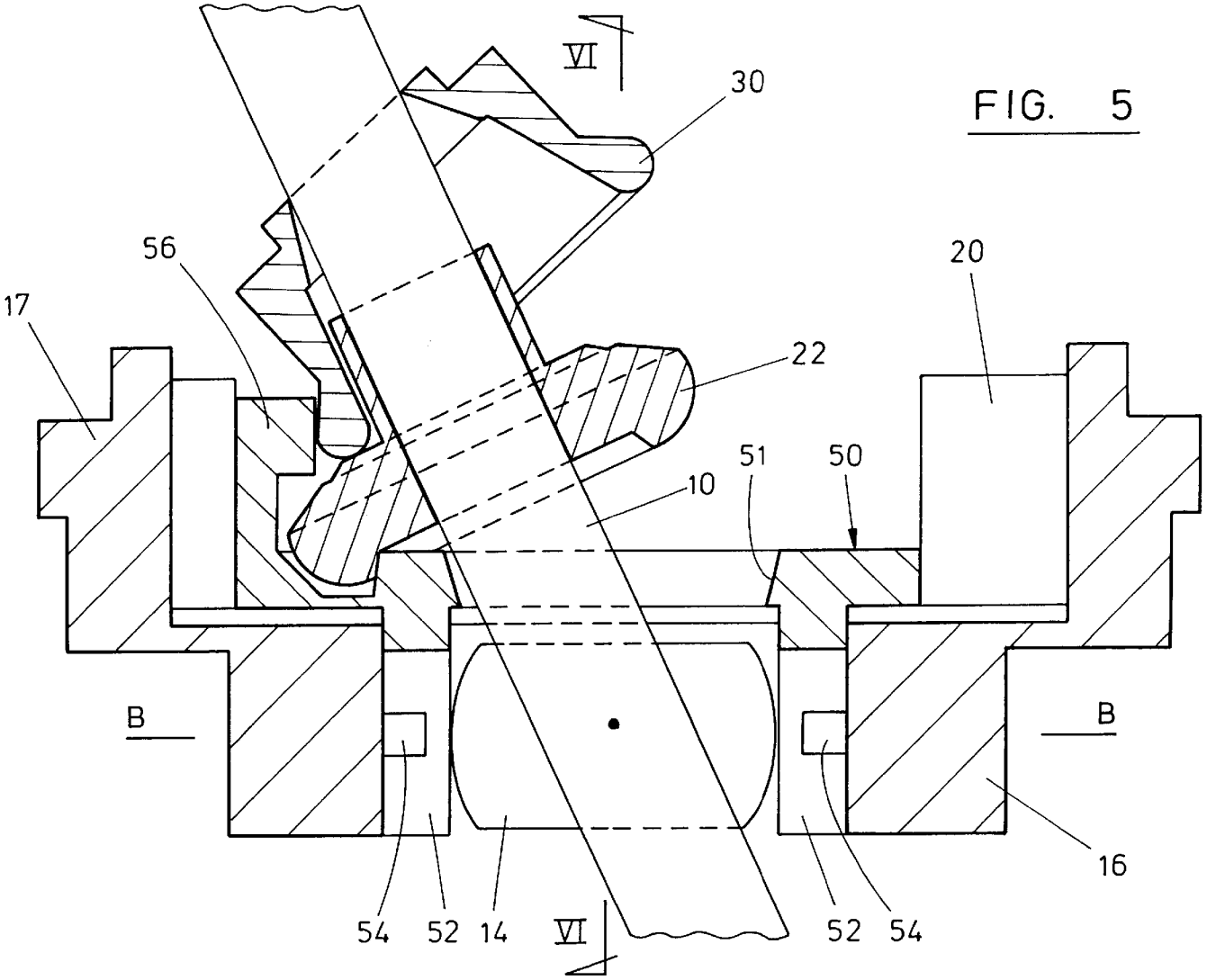
FIG. 5 is a similar section through the joystick controller of FIG. 4, showing the joystick lever displaced in the opposite direction along the same major axis.
Figure 6:
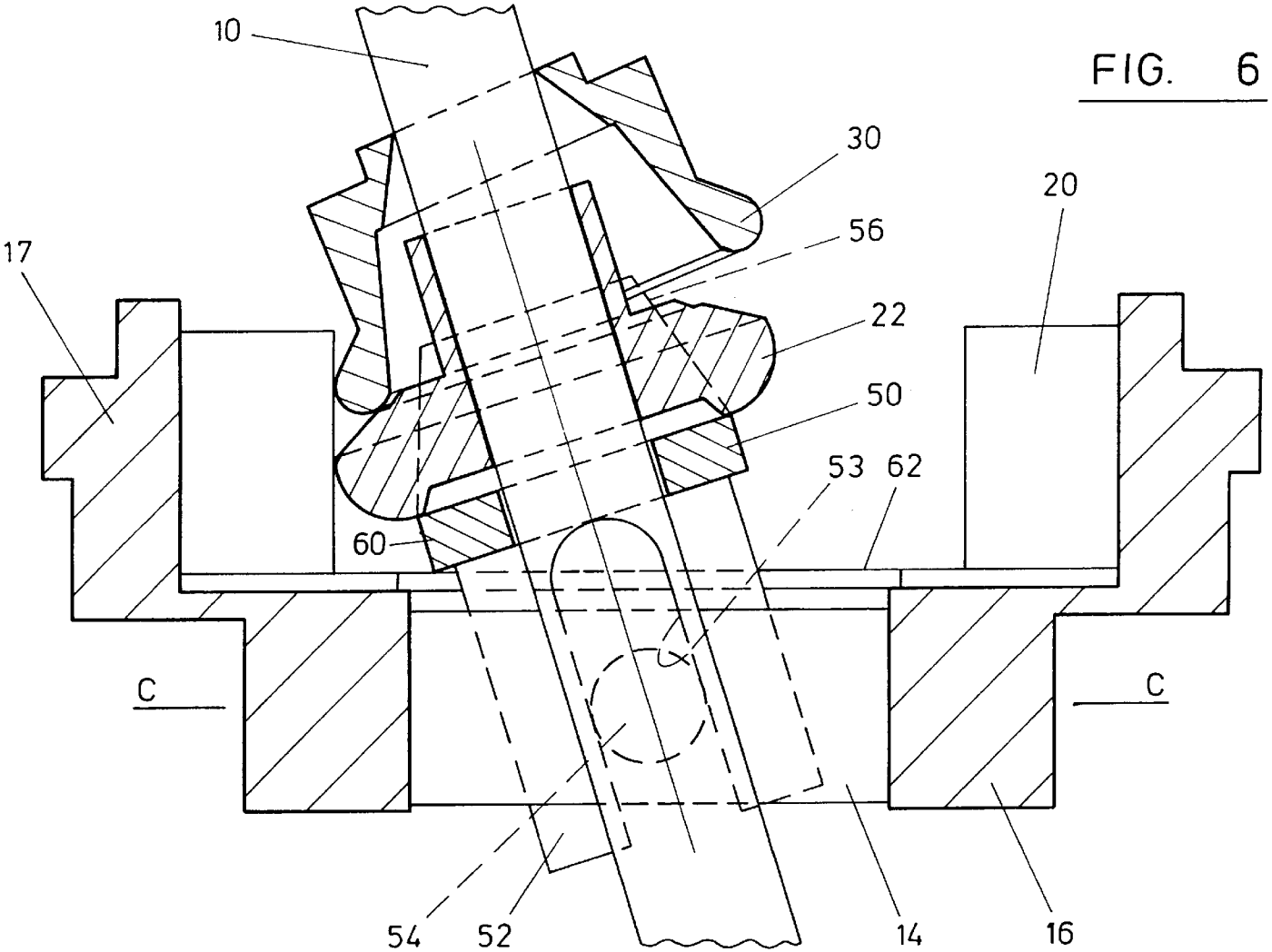
FIG. 6 is a section through the joystick controller of FIGS. 4 and 5, but on the line VI—VI indicated in FIG. 5.

FIGS. 4 to 6 show a third embodiment of joystick controller, which differs from that shown in FIG. 3 in that the joystick lever can be displaced to its temporarily locked position along the one major axis, and can thereafter still be displaced along the orthogonal major axis (whilst remaining locked). Thus, the fixed cam plate 18 of the controller of FIG. 3 is replaced by a cradle 50 having two depending legs 52 which project downwardly into the aperture 15 in the body 16, either side of the gimbal 14. The joystick shaft passes through a slot 51 in the cradle 50. The legs 52 of the cradle 50 are each formed with a longitudinal slot 53 and studs 54, projecting inwardly into the aperture 15 from opposite sides of the body 16, engage in the slots 53 of the respective legs 52: as a result, the cradle is pivotable about an axis B—B defined by the studs 54. In this embodiment, the gimbal 14 is mounted on studs (not shown) projecting inwardly from opposite sides of the body 16, for pivoting about an axis C—C indicated in FIG. 6, orthogonal to the axis B—B. Further, the joystick shaft 10 passes through the open center of the frame-shaped gimbal 14 and is pivoted to the latter for turning about an axis coincident with the axis B—B.

The main bush 22 of the joystick controller is urged against the top, generally flat surface of the cradle 50. If the joystick lever is moved along one of its major axes of displacement, as shown in FIGS. 4 and 5, then the controller operates in the same manner as described previously. For one direction of movement, as shown in FIG. 4, the secondary bush 30 will eventually abut the inner surface of the frame-shaped stop member 20 and the increased-resistance or "overpress" action is available in the same manner as previously described. For the opposite direction of movement, shown in FIG. 5, the corresponding side of the stop member 20 is recessed and instead the cradle 50 has an upstanding arm 56 against which the secondary bush will abut to provide the "overpress" feature. Continued movement of the joystick lever results in a temporary lock being achieved, the lower periphery of the main bush 22 locating in a detenting recess 58 formed partly in the top surface of the cradle and partly in the upstanding arm 56.

For movement of the joystick lever along the other, orthogonal major axis, as shown in FIG. 6, the main bush 22 will remain seated flat against the top surface of the cradle 50, and the cradle 50 will follow the pivotal movement of the joystick lever by correspondingly pivoting on its studs 54. At the same time, leading edge portions 60 of the cradle, adjacent its opposite ends, slide on a top surface 62 of the body 16, causing the cradle 50 to be displaced upwardly along the shaft 10 (against the bias of the return spring) as the shaft displacement progresses: the longitudinal slots 53 in the legs 52 of the cradle 50 allow the cradle to slide upwardly on its pivot studs 54. It will be appreciated from FIG. 6 that, in either direction of movement along this particular major axis, the secondary bush 30 will eventually abut the inner surface of the stop member 20, to provide the "overpress" feature in the same manner as previously described for the controller of FIG. 1.

It will moreover be appreciated that if the joystick lever is moved to its temporarily-locked position along the one major axis (as shown in FIG. 5), the joystick lever can still be displaced along the other, orthogonal major axis.

A further advantageous feature of the joystick controller of FIGS. 4 to 6 is that the resistance to movement of the joystick lever in any compound direction (i.e. inclined to both major axes) is greater than the resistance to movement along either axis. This is because movement of the joystick lever in such a compound direction produces not only a partial compression of the return spring due to tilting the main bush 22 relative to the top surface of the cradle 50, but also an additional partial compression of the return spring due to tilting the cradle itself.

Figure 7:
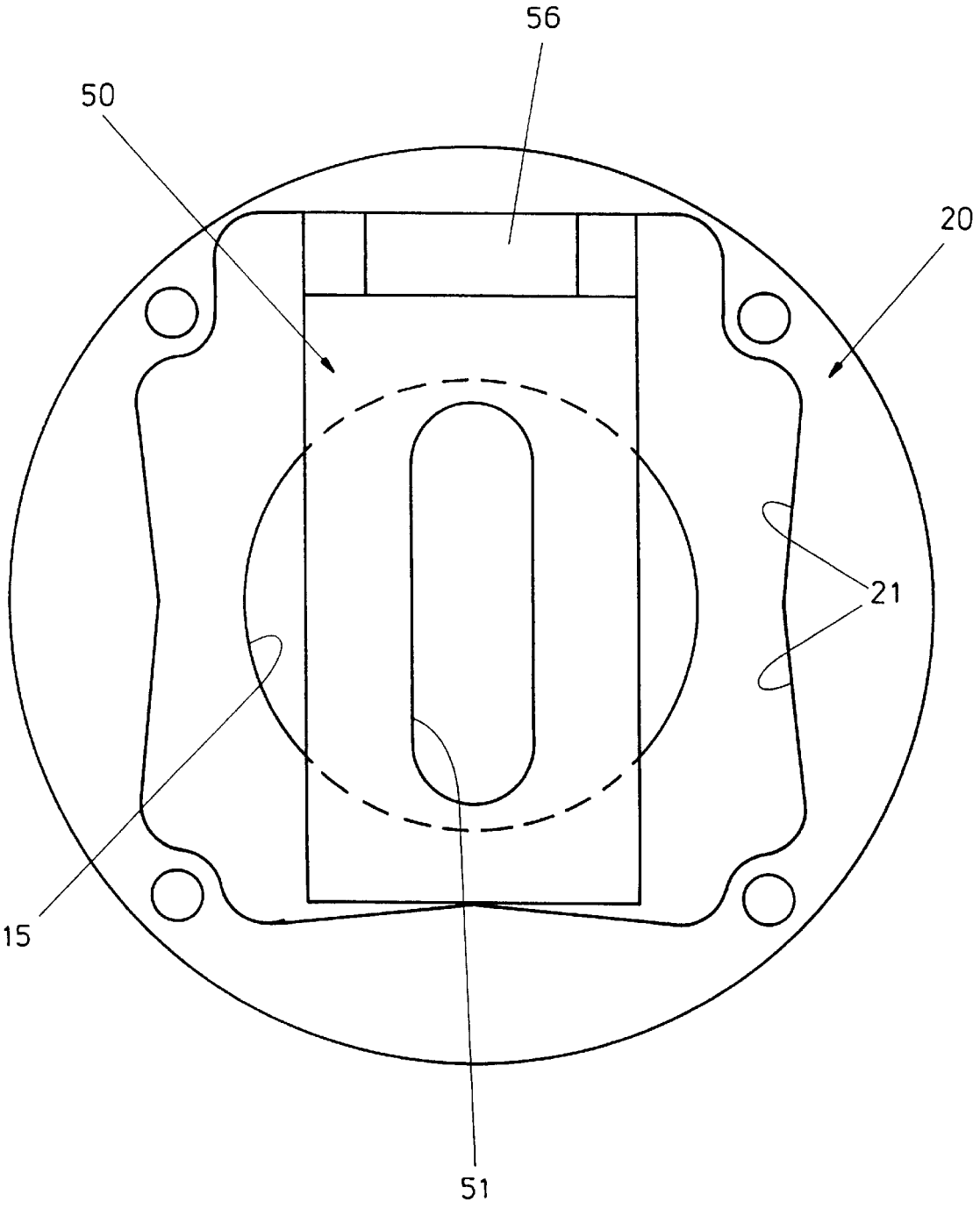
FIG. 7 is a plan view of the stop member of the joystick controller of FIGS. 4 to 6.

FIG. 7 shows the stop member 20 in plan view and shows that one of the inner sides of this member is recessed to accommodate the upstanding arm 56 of the cradle. It will be appreciated that each of the other inner sides of the stop member are abutted by the secondary bush 30, when the joystick lever is displaced in the corresponding direction to provide 15 the "overpress" feature. However, each of these three inner sides departs slightly from a straight line: in particular, each side comprises two straight-line portions 21 which incline outwardly towards the opposite ends of that side, starting from its centre. Thus, the joystick lever can be moved to an end position along either of its two major axes of displacement, for the secondary bush to abut the respective inner side of the stop member 20: thereafter, the joystick lever can be displaced in the perpendicular direction, its secondary bush sliding along the same inner side of the stop member, but the profile of this inner side surface compensates for the fact that the bushes 22, 30 are being pushed further up the shaft 10, to maintain the shaft at the same maximum angle of displacement along the first major axis.

Figure 8:
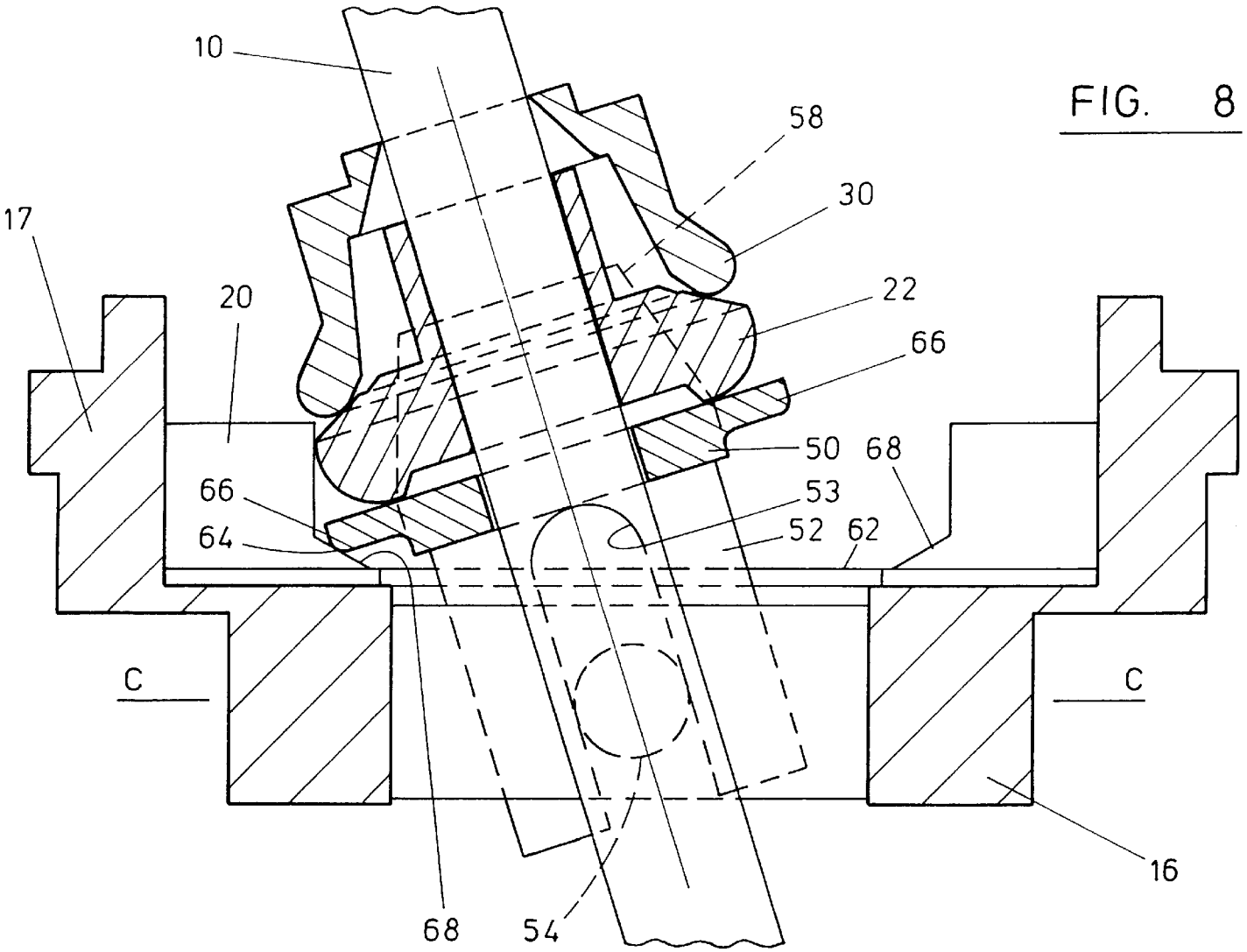
FIG. 8 is a section similar to FIG. 6, through a fourth embodiment of joystick controller in accordance with the invention.

Referring to FIG. 8, there is shown a fourth embodiment of joystick controller which differs from the joystick controller of FIGS. 4 to 6 in that two independent arrangements for the "overpress" feature are provided, operative from the two different major axes of displacement of the joystick lever. For one major axis of displacement, i.e. lengthwise of the cradle 50, the arrangements is the same as shown and described with reference to FIGS. 4 and 5. For the other major axis of displacement, then as shown in FIG. 8, the leading edge 64 of a projecting portion 66 of the cradle (midway between its opposite ends) eventually meets an inclined or ramp surface 68 formed on the stop member 20: further movement of the joystick lever in this direction causes the leading edge 64 to slide up the ramp surface 68 and so urge the cradle 50 upwardly along the shaft 10, against the bias of the return spring. It will be appreciated that this accordingly provides the increased-resistance or "overpress" feature: the secondary bush 30 does not abut the stop member 20. Displacement of the joystick lever is finally limited by the leading edge 64 and/or the main bush 22 abutting the corresponding upright inner side of the stop member.

It will be appreciated that because, in the joystick controller of FIG. 8, there are separate "overpress" arrangements for the two major axes of displacement, the joystick lever can be moved to an "overpress" position on either axis, and can thereafter be moved to an "overpress" position along the other major axis.

What is claimed is:

1. An electrical joystick controller, comprising a pivoted joystick lever, a main bush carried on the joystick lever and co-operating with a cam surface, a secondary bush carried on said lever and biased against an inclined surface of the main bush to correspondingly bias the main bush against the cam surface, and a stop against which a portion of the secondary bush abuts when said lever is pivoted through a predetermined angle parallel to a major axis of displacement, such that further displacement of said lever in the same direction causes said secondary bush to slide along said inclined surface of the main bush and displace against said bias.

2. A joystick controller as claimed in claim 1, wherein said stop comprises a surface extending generally perpendicular to the respective major axis of movement of the joystick lever, and is arranged such that an increased-resistance effect due to abutment of said secondary bush commences at substantially the same position of the lever parallel to said major axis, regardless of the position to which it may have been moved along another orthogonal major axis of movement.

3. A joystick controller as claimed in claim 2, wherein said stop surface comprises two portions which are inclined outwardly starting from the center of said stop surface.

4. A joystick controller as claimed in claim 2, wherein said stop is generally square in shape, such that the same increased-resistance effect due to the abutment of said secondary bush is experienced for movements of the joystick lever in either direction along each of its two major axes of displacement.

5. A joystick controller as claimed in any of claim 2 wherein the abutment of said secondary bush provides an increased-resistance effect for movement of the joystick lever in at least one direction along one of its two major axes of displacement, a separate arrangement providing an increased resistance effect for movement of the joystick lever in at least one direction along the other of its two major axes of displacement.

6. A joystick controller as claimed in claim 5, wherein the cam surface, with which the main bush co-operates, is provided on a cradle which pivots when the joystick lever is moved along said orthogonal major axis, the cradle having a leading edge which slides on a stationary surface of the controller such that the cradle is displaced along the joystick lever against said increased-resistance effect for movement along the respective major axis when said joystick lever is moved beyond a predetermined position along the major axis.

7. A joystick controller as claimed in claim 1, in which said cam surface is formed with a recess into which a portion of said main bush locates at a predetermined position of displacement of said joystick lever.

8. A joystick controller as claimed in claim 7, wherein said cam surface, is provided on a cradle such that the joystick lever can be displaced along one major axis, until its main bush locks into the recess formed in the cam surface of the cradle, the cradle then pivoting when the joystick lever is moved along another orthogonal major axis.

* * * * *